US006174409B1

(12) United States Patent
Sundaram et al.

(10) Patent No.: US 6,174,409 B1
(45) **Date of Patent: *Jan. 16, 2001**

(54) METHOD TO IMPROVE FINAL BLEACHED PULP STRENGTH PROPERTIES BY ADJUSTING THE CI02:03 RATION WITHIN A SINGLE (D/Z) STAGE OF THE BLEACHING PROCESS

(75) Inventors: V. S. Meenakshi Sundaram, Burr Ridge; Steven A. Fisher, Lyons; Sebastien Corbeil, Willowbrook, all of IL (US)

(73) Assignee: American Air Liquide Inc., Walnut Creek, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/934,119

(22) Filed: Sep. 19, 1997

(51) Int. Cl.[7] ..... D21C 9/14; D21C 9/153

(52) U.S. Cl. ..... 162/49; 162/62; 162/65; 162/89; 700/117; 700/266

(58) Field of Search ..... 162/65, 88, 89, 162/66, 67, 78, 49, 62, 61; 700/117, 127, 129, 266, 271

(56) References Cited

U.S. PATENT DOCUMENTS

| | | | | |
|---|---|---|---|---|
| 3,660,225 | | 5/1972 | Verreyne et al. . | |
| 3,742,735 | | 7/1973 | Verreyne et al. . | |
| 3,886,034 | * | 5/1975 | Noreus | 162/49 |
| 3,941,649 | * | 3/1976 | Wallin | 162/62 |
| 4,657,633 | | 4/1987 | Dwiggins . | |
| 4,743,339 | * | 5/1988 | Faix et al. | 162/49 |
| 4,902,381 | | 2/1990 | Meredith . | |

(List continued on next page.)

FOREIGN PATENT DOCUMENTS

| | | | | |
|---|---|---|---|---|
| 970111 | | 7/1975 | (CA) . | |
| 1 178 756 | | 12/1984 | (CA) . | |
| 2017334 | | 11/1991 | (CA) . | |
| 2031848 | | 4/1995 | (CA) . | |
| 2031850 | | 4/1995 | (CA) . | |
| 769631 | | 10/1997 | (CA) . | |
| 0 308 314 | | 9/1988 | (EP) . | |
| WO 85/00046 | | 1/1985 | (WO) . | |
| WO 90/13705 | | 11/1990 | (WO) . | |
| WO 92/03609 | | 3/1992 | (WO) . | |
| 92/17639 | * | 10/1992 | (WO) | 162/89 |
| WO 93/1526 | | 8/1993 | (WO) . | |

OTHER PUBLICATIONS

C. Dence and Reeve. Pulp Bleaching: Principles and Practice, pp. 724–733, 734. Published 1996 by TAPPI Press.

G. Smook. Handbook for Pulp and Paper Technologists, p. 310. Published 1989 by TAPPI Press.

(List continued on next page.)

*Primary Examiner*—Steve Alvo
(74) *Attorney, Agent, or Firm*—Burns, Doane, Swecker & Mathis, L.L.P.

(57) ABSTRACT

Methods of bleaching cellulose pulp using chlorine dioxide and ozone in one and the same single stage of a bleaching sequence having a plurality of stages are presented. In its broadest embodiment the method comprises controlling a ratio of chlorine dioxide to ozone within a single stage of a first bleaching sequence in a range effective to achieve strength characteristics of a final paper elaborated from the first bleaching sequence at least as great as strength characteristics when compared to a control bleaching sequence, the control bleaching sequence being the same in all respects as the first bleaching sequence except not employing ozone in a stage, and for essentially the same final brightness of pulp elaborated from the first and the control bleaching sequence. Cellulose pulps made using the methods of the invention are also described.

25 Claims, 5 Drawing Sheets

ClO2:O3 Ratio On Mechanical Strength, Tear vs Tensile, Example 1, the 3 Stage Sequence

U.S. PATENT DOCUMENTS

| | | |
|---|---|---|
| 4,959,124 | 9/1990 | Tsai . |
| 5,328,564 | 7/1994 | Jiang et al. . |
| 5,364,505 | 11/1994 | Funk et al. . |
| 5,382,326 | 1/1995 | Szopinski et al. . |
| 5,389,201 | 2/1995 | Tsai . |
| 5,411,633 | 5/1995 | Phillips et al. . |
| 5,411,634 | 5/1995 | Henricson et al. . |
| 5,415,734 | 5/1995 | Backlund et al. . |
| 5,645,687 | 7/1997 | Ambady et al. . |

OTHER PUBLICATIONS

F. Granum, K. Hasvold, V. Loras, and N. Soteland. "Influence of Bleaching Chemicals and Sequences on Some Properties of Sulphite Pulps." Journal of Pulp and Paper Science, Mar. 1984, pp. 25–30.

Per Larsson and Olaf Samuelson. "Bleaching of Kraft Pulp without Chlorination." Nordic Pulp and Paper Research Journal, No. 4/1990, pp. 180–187.

* cited by examiner

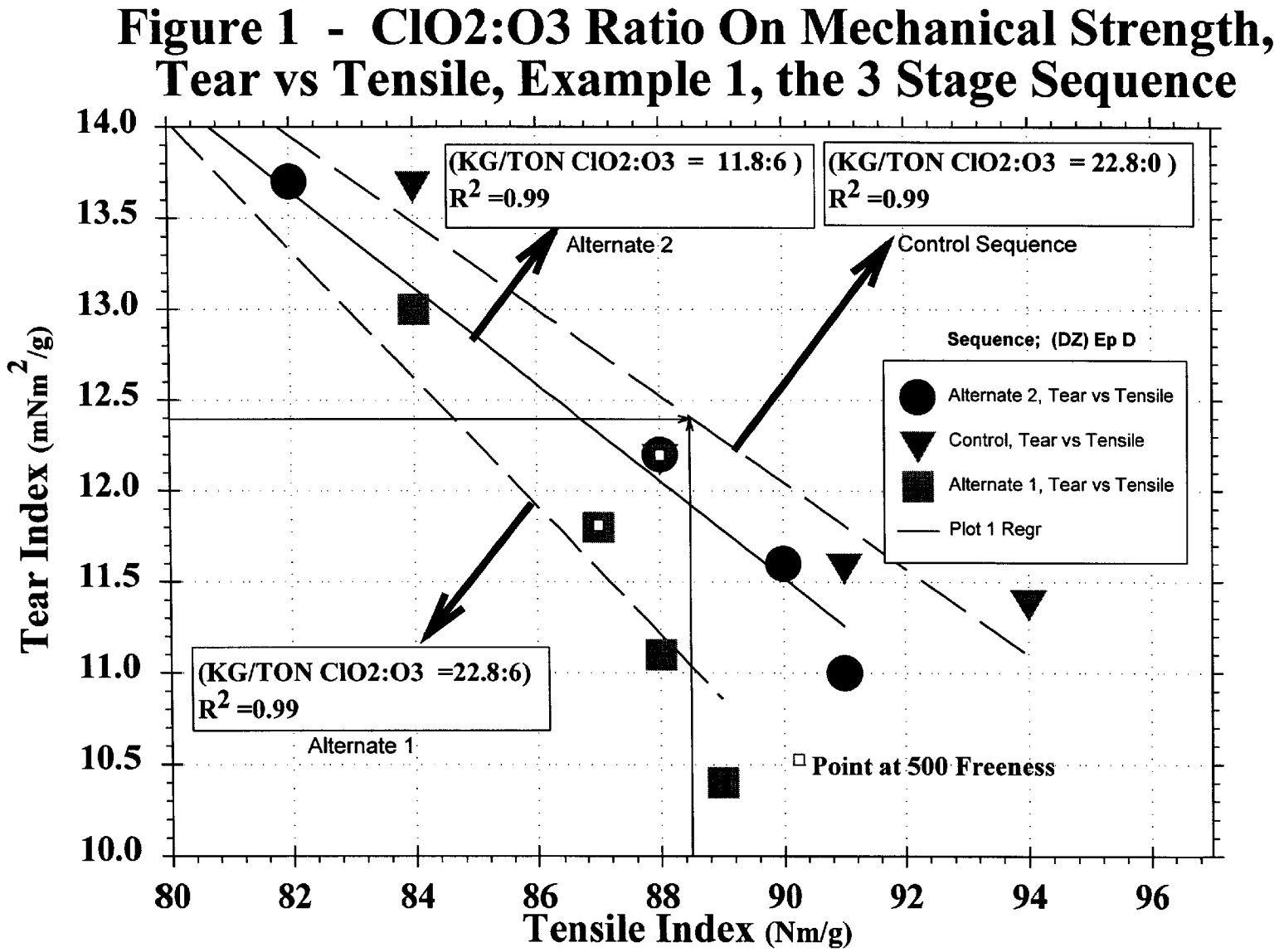
Figure 1 - ClO2:O3 Ratio On Mechanical Strength, Tear vs Tensile, Example 1, the 3 Stage Sequence
(KG/TON ClO2:O3 = 11.8:6 )
R2 =0.99
(KG/TON ClO2:O3 = 22.8:0 )
R2 =0.99
Control Sequence
Alternate 2
Sequence; (DZ) Ep D
Alternate 2, Tear vs Tensile
Control, Tear vs Tensile
Alternate 1, Tear vs Tensile
Plot 1 Regr
Point at 500 Freeness
(KG/TON ClO2:O3 =22.8:6)
R2 =0.99
Alternate 1
Tear Index (mNm2/g)
14.0
13.5
13.0
12.5
12.0
11.5
11.0
10.5
10.0
80
82
84
86
88
90
92
94
96
Tensile Index (Nm/g)

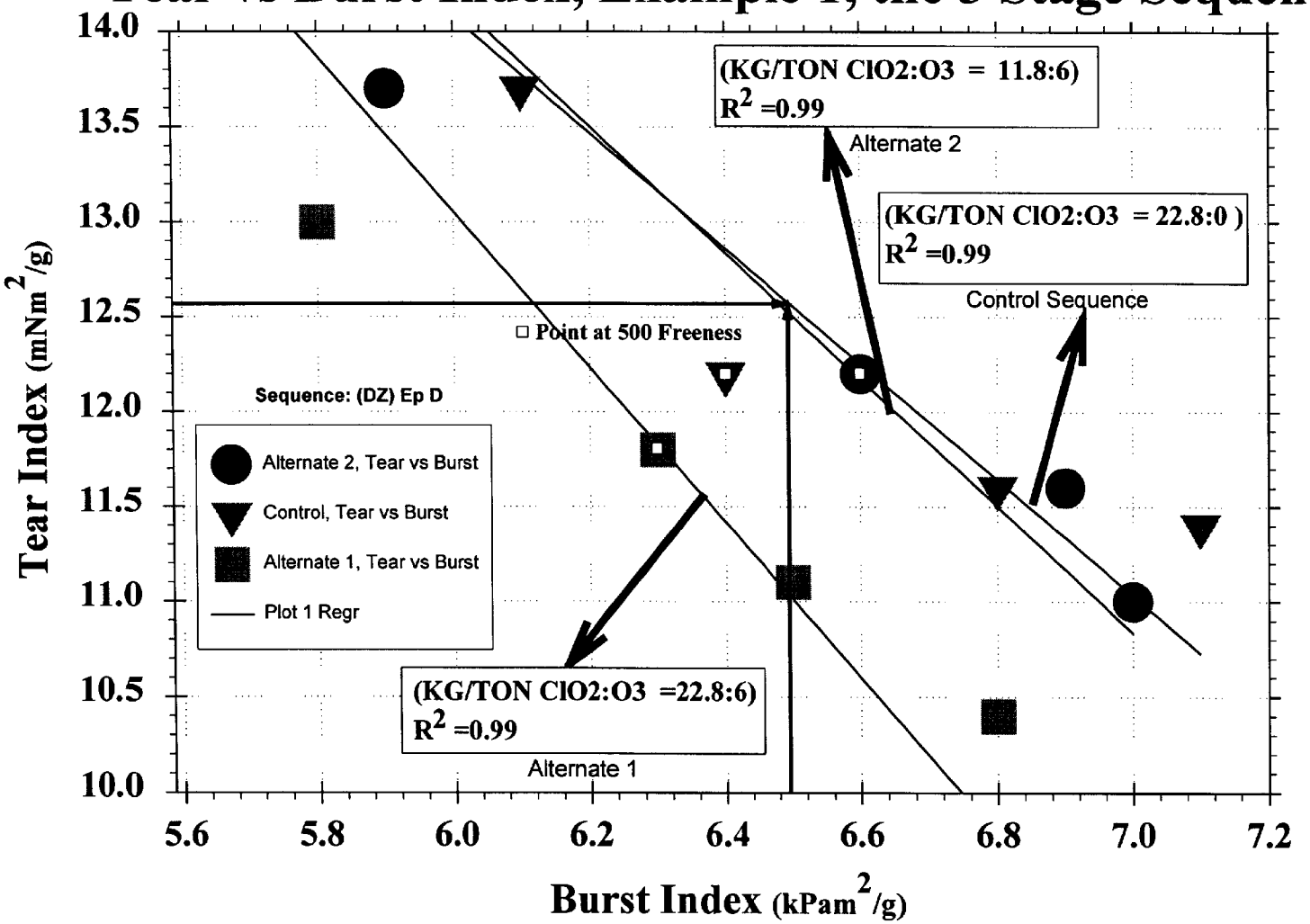
Figure 2 - ClO2:O3 Ratio On Mechanical Strength, Tear vs Burst Index, Example 1, the 3 Stage Sequence

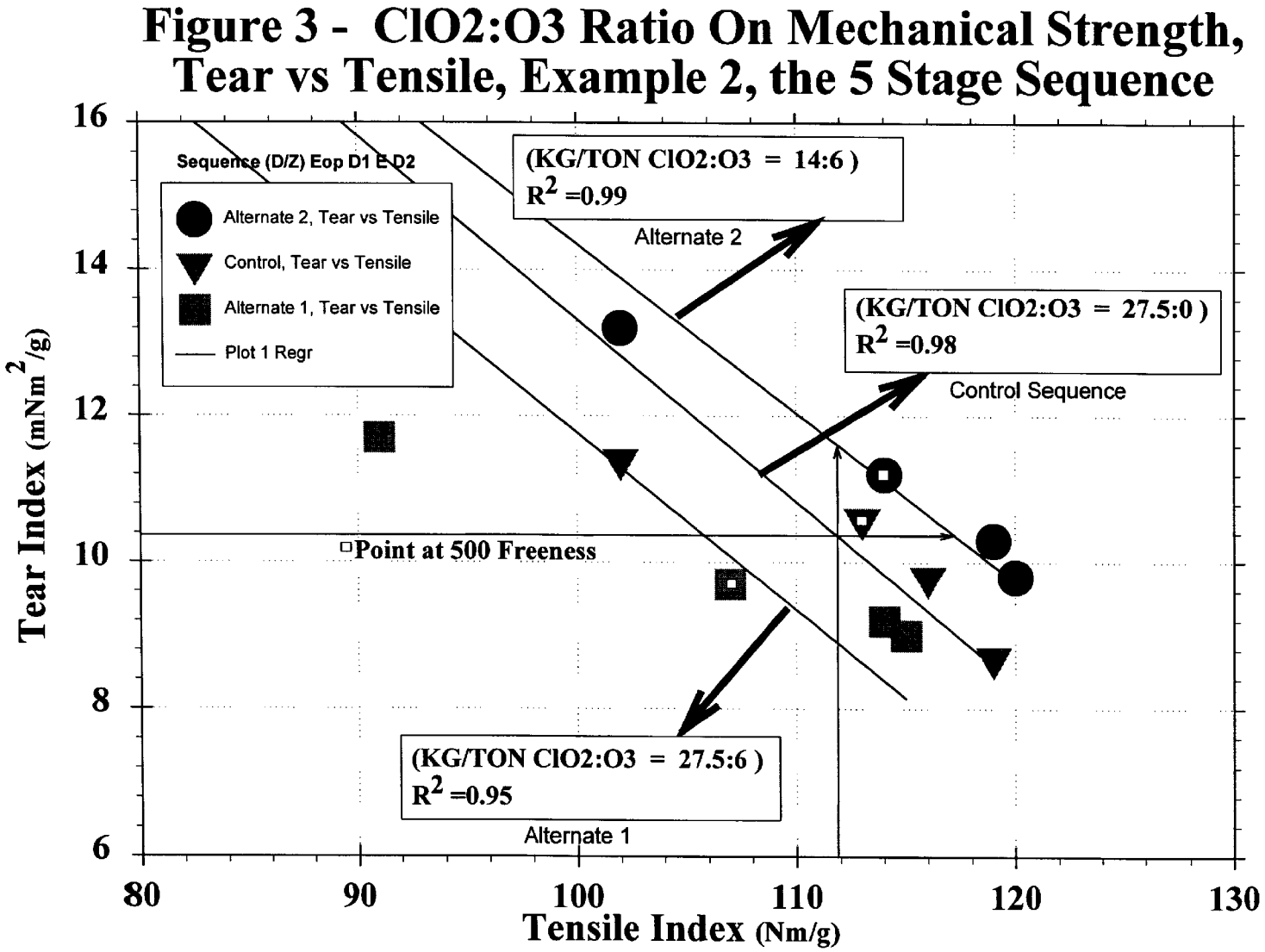
Figure 3 - ClO2:O3 Ratio On Mechanical Strength, Tear vs Tensile, Example 2, the 5 Stage Sequence
Sequence (D/Z) Eop D1 E D2
Alternate 2, Tear vs Tensile
Control, Tear vs Tensile
Alternate 1, Tear vs Tensile
Plot 1 Regr
(KG/TON ClO2:O3 = 14:6 )
R2 =0.99
Alternate 2
(KG/TON ClO2:O3 = 27.5:0 )
R2 =0.98
Control Sequence
Point at 500 Freeness
(KG/TON ClO2:O3 = 27.5:6 )
R2 =0.95
Alternate 1
Tear Index (mNm2/g)
16
14
12
10
8
6
Tensile Index (Nm/g)
80
90
100
110
120
130

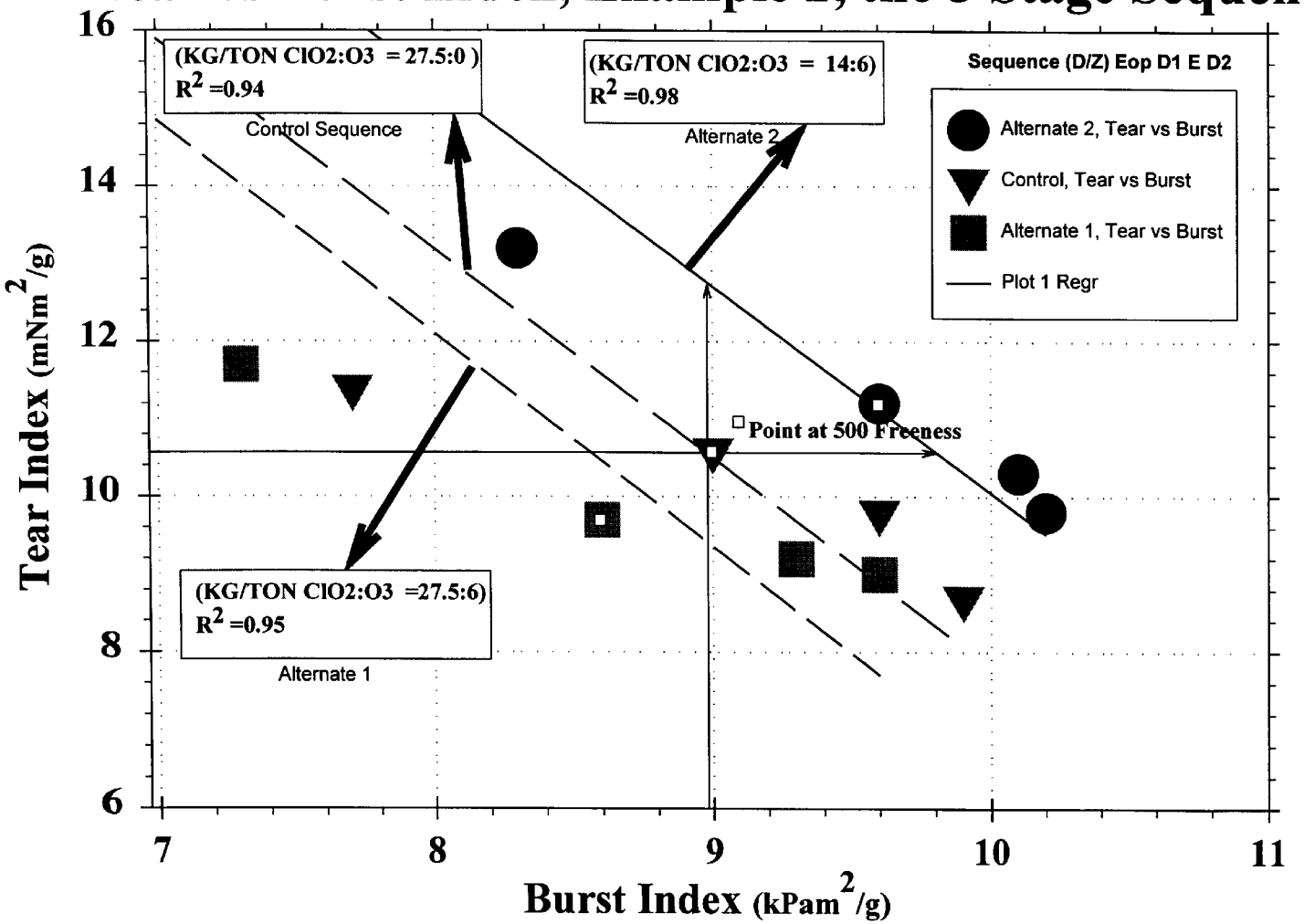
Figure 4 - ClO2:O3 Ratio On Mechanical Strength, Tear vs Burst Index, Example 2, the 5 Stage Sequence

Figure 5 : The Apparatus used for the first stage of each laboratory bleaching sequence that used ozone and/or chlorine dioxide.
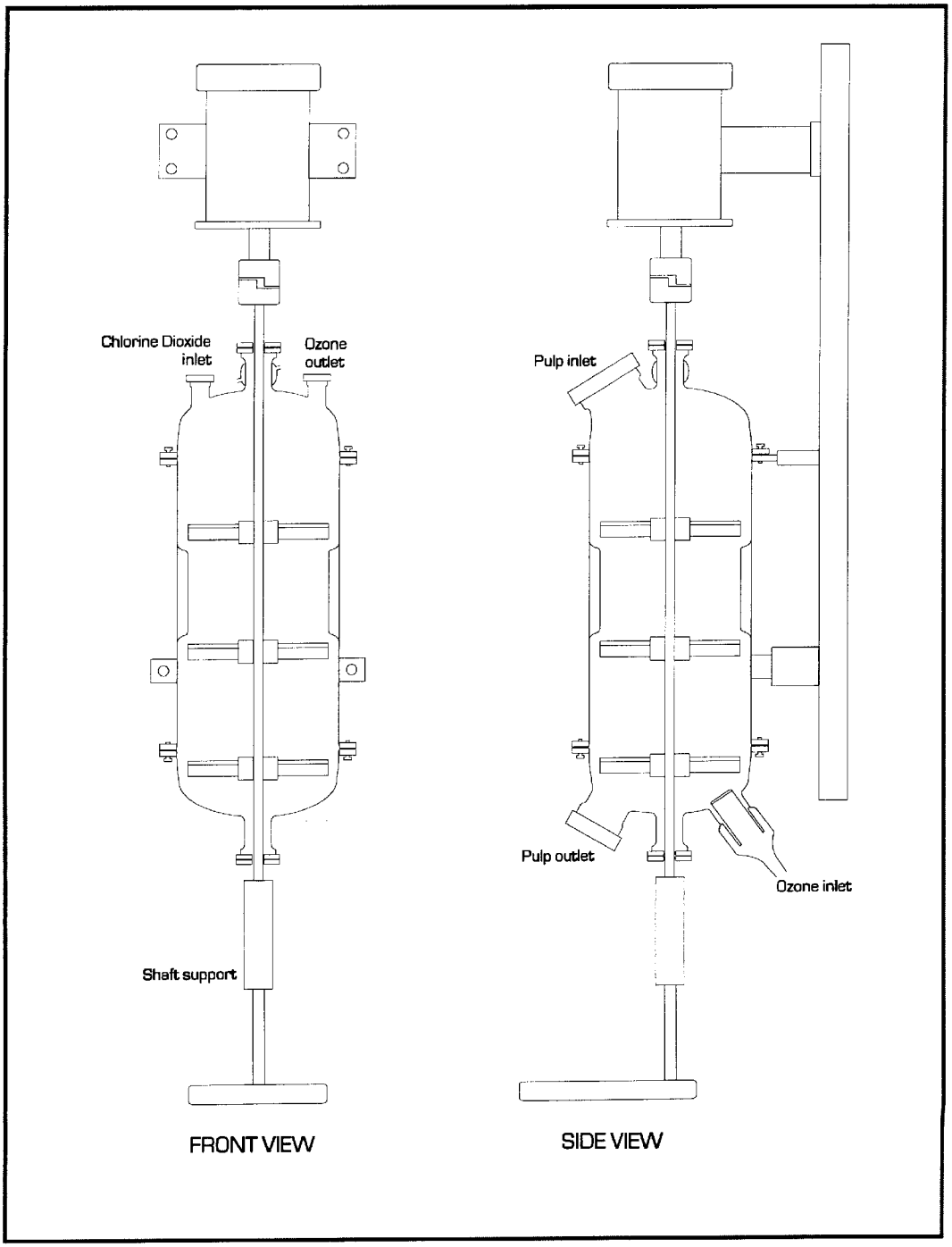

METHOD TO IMPROVE FINAL BLEACHED PULP STRENGTH PROPERTIES BY ADJUSTING THE CI02:03 RATION WITHIN A SINGLE (D/Z) STAGE OF THE BLEACHING PROCESS

BACKGROUND OF THE INVENTION

1. Field of the Invention

The present invention is related in general to bleaching of cellulose pulps. More specifically, the present invention concerns methods of bleaching cellulose pulps with chlorine dioxide.

2. Related Art

Bleaching of cellulose pulps typically employs chlorine containing chemicals. Efforts have been made to reduce their use because of pollution concerns, however their use has continued. This due at least in part because the brightness of the paper made from the pulps obtained using other oxidizers is either obtained at greater cost, and/or the strength of the paper ultimately produced from the bleached cellulose pulp does not meet manufacturer and consumer requirements.

Some pulps processors using chlorine dioxide will use the chlorine dioxide to bleach cellulose pulp in the initial pulp bleaching stage or stages, and then, in additional stages, add a non-chlorinated oxidizer for meeting final brightness specifications of the paper. This approach, while commendable because the final strength of the paper is good, leads to only a small reduction in actual chlorine dioxide usage. Other processors have added chlorine dioxide and non-chlorine-containing oxidizers to pulp to be bleached in one and the same stage; however, these pulp processors have not adjusted the ratio of chlorine dioxide to non-chlorine-containing oxidizer in a manner that affects strength of the final paper produced. Indeed such a relationship of this ratio to paper strength has heretofore not been recognized by prior practitioners. The only direction given on how to achieve good strength characteristics of the final paper when using ozone and chlorine dioxide is the viscosity of the treated pulp. However, a drawback of the viscosity test as a selectivity rating is that it is known that the correlation between pulp viscosity and strength characteristics of ozone-treated pulps differs from that of chlorine-treated pulps. (It can also be seen in Example-2/Table 2 & FIGS. 3 & 4) Depending on the reaction conditions and the treatment history of the pulp, ozone-treated pulps can have much lower viscosity values than pulps bleached with chlorine-based sequences to the same strength (see *Pulp Bleaching: Principles and Practice*, by C. Dence and D. Reeve, p. 734, published 1996 by TAPPI Press).

There is thus a genuine need in the art of cellulose pulp bleaching for methods of bleaching these pulps using chlorine dioxide and ozone in ratios that do not sacrifice pulp brightness or strength characteristics of the final paper made from the bleached pulps, while also keeping in mind the strict environmental rules and regulations now in force in many regions of the world.

SUMMARY OF THE INVENTION

In accordance with the present invention, methods are presented which surprisingly recognize and overcome some if not all of the problems encountered in the prior art. The inventive methods are valid for conventional cooked and oxygen delignified pulps.

One aspect of the invention is a method of bleaching cellulose pulp using chlorine dioxide and ozone in one and the same first stage of a bleaching sequence having a plurality of stages, the method comprising controlling a ratio of chlorine dioxide to ozone in a first stage of a first bleaching sequence in a range effective to achieve strength characteristics of a final paper elaborated from the first bleaching sequence at least as great as strength characteristics when compared to a control bleaching sequence, the control bleaching sequence being the same in all respects as the first bleaching sequence except not employing ozone in the first stage, and for essentially the same final brightness of pulp elaborated from the first and the control bleaching sequence.

A second aspect of the invention is a method of bleaching cellulose pulp in a bleaching sequence (D/Z)$E_{op}$PD or (Z/D)$E_{op}$PD to produce a novel bleached pulp, the method comprising employing a ratio of chlorine dioxide to ozone in a first bleaching stage (D/Z) or (Z/D), the ratio effective to produce a first set of curves of properties defining strength characteristics of the novel bleached pulp to be substantially similar to or better than a second set of curves of properties defining strength characteristics of the same beginning pulp bleached using a control bleaching sequence D$E_{op}$D to produce a control bleached pulp, the novel bleached pulp and the control bleached pulp having essentially the same brightness.

A third aspect of the invention is a method of bleaching cellulose pulp in a bleaching sequence (D/Z)$E_{op}DE_pD$ or (Z/D)$E_{op}DE_pD$ to produce a novel bleached pulp, the method comprising employing a ratio of chlorine dioxide to ozone in a first bleaching stage (D/Z) or (Z/D), the ratio effective to produce a first set of curves of properties defining strength characteristics of the novel bleached pulp to be substantially similar to or better than a second set of curves of properties defining strength characteristics of the same beginning pulp bleached using a control bleaching sequence $DE_{op}DE_pD$ to produce a control bleached pulp, the novel bleached pulp and the control bleached pulp having essentially the same brightness.

A fourth aspect of the invention is a method of bleaching cellulose pulp in a bleaching sequence O(D/Z)$E_{op}$D or O(Z/D)$E_{op}$D to produce a novel bleached pulp, the method comprising employing a ratio of chlorine dioxide to ozone in a first bleaching stage (D/Z) or (Z/D), the ratio effective to produce a first set of curves of properties defining strength characteristics of the novel bleached pulp to be substantially similar to or better than a second set of curves of properties defining strength characteristics of the same beginning pulp bleached using a control bleaching sequence O$DE_{op}$D to produce a control bleached pulp, the novel bleached pulp and the control bleached pulp having essentially the same brightness.

A fifth aspect of the invention is a method of bleaching cellulose pulp in a bleaching sequence O(D/Z)$E_o$D or O(Z/D)$E_o$D to produce a novel bleached pulp, the method comprising employing a ratio of chlorine dioxide to ozone in a first bleaching stage (D/Z) or (Z/D), the ratio effective to produce a first set of curves of properties defining strength characteristics of the novel bleached pulp to be substantially similar to or better than a second set of curves of properties defining strength characteristics of the same beginning pulp bleached using a control bleaching sequence O$DE_o$D to produce a control bleached pulp, the novel bleached pulp and the control bleached pulp having essentially the same brightness.

Pulps and final paper products made using one of the methods of the invention are also considered within the invention.

As used herein the terms used to describe the invention have the following meanings:

"brightness" means the value of ISO brightness using the ISO 3688-1977 method for handsheet preparation and brightness measurement, which is incorporated herein by reference, and "essentially the same brightness" means brightness measurements being the same within standard analytical chemistry laboratory error calculations;

"ratio" means the mass of chlorine dioxide divided by the mass of ozone, both relative to one ton of oven dried pulp used in the first stage of the inventive bleaching sequences;

"stage" has the meaning of TAPPI standard number TIS 0606-21, dated 1988, incorporated herein by reference;

the letter designations D, E, Z, Eo, Eop, having meaning derived from TAPPI standard number TIS-0606-21, dated 1988, which is incorporated herein by reference;

the designation "(D/Z)" means a single bleaching stage wherein chlorine dioxide and ozone are introduced to the pulp either at the same point, or at points separated from each other, or in mixed form, with the proviso that (D/Z) means chlorine dioxide is introduced first in the stage;

the designation "(Z/D)" means a single bleaching stage wherein chlorine dioxide and ozone are introduced to the pulp either at the same point, or at points separated from each other, or in mixed form, with the proviso that (Z/D) means ozone is introduced first in the stage;

"pulp" means aqueous conventional cooked pulp or aqueous oxygen delignified pulp, preferably having a consistency ranging from about 1 to about 30, more preferably ranging from about 2 to about 15, more preferably ranging from about 2 to about 5, wherein consistency is the percentage by weight of the oven-dried fibrous material in the total mixture of fibrous material plus aqueous solution.

"final paper" means the paper made in handsheets for strength testing, in accordance with TAPPI method number T 205 sp 95 dated 1995, "Forming handsheets for physical testing of pulp".

"strength characteristics" includes results of tests performed in accordance with TAPPI standard number T T220 sp 96 "Physical testing of pulp handsheets", wherein there consists: tensile index testing performed in accordance with TAPPI test number T 494; results of tear index performed in accordance with TAPPI test number T 414; results of burst strength performed in accordance with TAPPI test number T 403;

"kappa number" is a measure of the amount of lignin in a pulp sample, and its measurement is defined in TAPPI standard number T 236 cm 85, dated 1993, incorporated herein by reference;

"kappa factor" is used as a way to incorporate the starting kappa number into the calculation of the chlorine dioxide to be used in the first bleaching stage, and is defined in relation to the percent chlorine dioxide as follows:

$$\% \ ClO2=(\text{kappa factor})(\text{kappa number})/2.63,$$

wherein typical kappa factors depend upon the pulp species, the incoming kappa number to the bleach plant, the amount of lignin-rich water retained by the pulp from the brownstock washers (designated as "brownstock carryover"), the final target brightness, and other considerations inherent to the operation of the individual bleach plant.

"control sequence" is that sequence that has the same number, order and type of stages as the comparative sequence(s) that include(s) ozone in one or several of the stages that contain chlorine dioxide. For example, the control sequence D $E_{op}$ D E D may be compared to the "alternate sequence" (DZ) $E_{op}$ D E D. For the purpose of comparison of strength characteristics, each compared sequence is bleached to the same final brightness.

These and other aspects and advantages of the invention will become apparent from reading the following brief description of the drawing, description of preferred embodiments, and claims.

BRIEF DESCRIPTION OF THE DRAWING

FIG. 1 is a plot of three curves of tensile index vs. tear index for a control bleaching sequence and two alternate bleaching sequences, Alternate 2 being the method of bleaching cellulose pulp in accordance with the present invention using Example 1;

FIG. 2 is a plot of three curves of burst index vs. tear index for a control bleaching sequence and two alternate bleaching sequences, Alternate 2 being the method of bleaching cellulose pulp in accordance with the present invention using Example 1;

FIG. 3 is a plot of three curves of tensile index vs. tear index for a control bleaching sequence and two alternate bleaching sequences, Alternate 2 being the method of bleaching cellulose pulp in accordance with the present invention using Example 2;

FIG. 4 is a plot of three curves of burst index vs. tear index for a control bleaching sequence and two alternate bleaching sequences, Alternate 2 being the method of bleaching cellulose pulp in accordance with the present invention using Example 2; and FIG. 5 illustrates in schematic form a bleaching apparatus used for the examples herein.

DESCRIPTION OF PREFERRED EMBODIMENTS

This effort was focused on determining the effectiveness of ozone (Z) and chlorine dioxide (D) in the bleaching of pulp, as compared to various control sequences containing a first stage using chlorine dioxide without ozone. More specifically, to demonstrate that the $ClO_2$ to $O_3$ ratio in (D/Z) in the first stage of a bleaching sequence is important to the preservation of strength of the final paper elaborated from bleached pulp.

The methods of the invention are applicable to all bleachable pulps, including kraft, sulphite, oxygen delignified, chemical, mechanical, and chemical-mechanical pulps. Most preferably the methods of the invention are applicable to low consistency cellulose pulps (consistency less than or equal to about 5 percent).

Preferred bleaching sequences in accordance with the invention include the following:

| | |
|---|---|
| $(D/Z)E_{op}D$ | $E_O(D/Z)E_{OP}D$ |
| $(D/Z)E_{op}DE_pD$ | $E_{OP}(D/Z)E_OD$ |
| $O(D/Z)E_{op}D$ | $E_O(Z/D)E_{OP}D$ |
| $O(D/Z)E_oD$ | $E_O(Z/D)E_{OP}D$ |
| $(Z/D)E_{op}D$ | $OO(D/Z)E_{OP}D$ |
| $(Z/D)E_{op}DE_pD$ | $OO(Z/D)E_{OP}D$ |

-continued

| | |
|---|---|
| $O(Z/D)E_{op}D$ | $(D/Z)E_{OP}(D/Z)$ |
| $O(Z/D)E_{o}D$ | $(D/Z)E_{OP}(Z/D)$ |

The ratio of chlorine dioxide to ozone in the (D/Z) stage, which will accomplish the desired strength characteristics substantially equivalent to the control sequence, preferably ranges from about 0.5 to about 2.5, more preferably from about 0.8 to about 1.5. The ratio of chlorine dioxide to ozone in the (Z/D) stage, which will accomplish the desired strength characteristics substantially equivalent to the control sequence, also preferably ranges from about 0.5 to about 2.5, more preferably from about 0.8 to about 1.5.

In bleaching sequences of the invention, the temperature of (D/Z) and (Z/D) stages typically and preferably ranges from about 30° C. to about 70° C., more preferably ranging from about 40° C. to about 60° C., more preferably ranging from about 45° C. to about 55° C.

The residence time of (D/Z) and (Z/D) stages of sequences of the invention typically and preferably ranges from about 20 to about 60 minutes, more preferably ranging from about 30 to about 50 minutes, depending primarily on the amount of ozone employed.

A target final pH for (D/Z) and (Z/D) stages of inventive bleaching sequences ranges from about 1.0 to about 4.0, more preferably ranging from about 2.0 to about 3.0.

A target consistency for (D/Z) and (Z/D) stages of inventive bleaching sequences ranges from about 1.0 to about 4.0, more preferably ranging from about 2.0 to about 3.0.

A final ISO brightness for (D/Z) and (Z/D) stages of inventive bleaching sequences ranges from about 35 to about 45, more preferably ranging from about 37 to about 43.

The percentage of hydrogen peroxide as a weight percent of oven dried pulp (% on pulp) in the first extraction stage (Ep or Eop) of three or five stage sequences of the invention, which will accomplish the desired strength characteristics substantially equivalent to the control sequence, preferably ranges from about 0.15 to about 0.25.

The percentage of caustic (as % on pulp) in Eop stages of three or five stage sequences of the invention, which will accomplish the desired strength characteristics substantially equivalent to the control sequence, preferably ranges from about 0.4 to about 1.8.

The percentage of caustic (as % on pulp) in the second extraction stage (after D1) of five stage sequences of the invention, which will accomplish the desired strength characteristics substantially equivalent to the control sequence, preferably ranges from about 0.2 to about 0.8.

In bleaching sequences of the invention, the temperature of $E_p$ and $E_{op}$ stages typically and preferably ranges from about 50° C. to about 90° C., more preferably ranging from about 60° C. to about 80° C., more preferably ranging from about 65° C. to about 75° C.

The residence time of Ep and Eop stages of sequences of the invention typically and preferably ranges from about 10 to about 70 minutes, more preferably ranging from about 30 to about 50 minutes.

A target final pH for Ep and Eop stages of inventive bleaching sequences ranges from about 7.5 to about 14, more preferably ranging from about 9.0 to about 12.5, more preferably from about 10 to about 12.

A target consistency for Ep and Eop stages of inventive bleaching sequences ranges from about 5.0 to about 15, more preferably ranging from about 8.0 to about 12.

The kappa number of the Ep stages (in other words the extraction stage after the (D/Z) or (Z/D) stage) of the inventive bleaching sequences of the invention typically and preferably ranges from about 4.0 to about 7.0, more preferably ranging from about 5.0 to about 6.0.

A final ISO brightness for the Ep stages (in other words the extraction stage after the (D/Z) or (Z/D) stage) of inventive bleaching sequences ranges from about 45 to about 55, more preferably ranging from about 48 to about 52.

In bleaching sequences of the invention, the temperature of a first D stage typically and preferably ranges from about 50° C. to about 90° C., more preferably ranging from about 60° C. to about 80° C., more preferably ranging from about 65° C. to about 75° C.

The amount of chlorine dioxide required to reach a target brightness for final pulp after the third stage (D) of a three stage sequence in accordance with the invention preferably ranges from 0.2 to about 1.2 percent by weight of oven dried pulp.

In bleaching sequences of the invention, the temperature of D stages typically and preferably ranges from about 50° C. to about 90° C., more preferably ranging from about 60° C. to about 80° C., more preferably ranging from about 65° C. to about 75° C.

The residence time of D stages of sequences of the invention typically and preferably ranges from about 10 to about 70 minutes, more preferably ranging from about 30 to about 50 minutes.

A target final pH for D stages of inventive bleaching sequences ranges from about 2.0 to about 5.0, more preferably ranging from about 3.5 to about 4.0.

A target consistency for D stages of inventive bleaching sequences ranges from about 5.0 to about 15, more preferably ranging from about 8.0 to about 12.

Final viscosity of pulp (measured in accordance with TAPPI standard number T 230 om-94, "Viscosity of pulp, capillary viscometer method" dated 1994), after a three stage bleaching sequence preferably is as high as possible, but typically and preferably ranges from about 15 to about 30 mPa-seconds, more preferably from about 20 to about 30 mPa-seconds.

Final brightness (ISO) after a three stage or five stage bleaching sequence in accordance with the invention preferably is as high as possible, but preferably ranges from about 85 to about 90.

EXAMPLES

It was desirable to choose the types of pulp for experimentation that currently dominate in volume of production upon successful application of this technology.

The work was performed in two phases. Phase 1 utilized a pulp that was seen as typical and available in large quantities, for which in-house data was available to show that it has a favorable response to the (D/Z) bleaching process. The parameters chosen for this test utilized benchmark conditions to demonstrate the strength preservation, and were used as a benchmark for study of the range of pulps and conditions for which the methods of the invention are applicable.

The chosen pulps (as described below) were bleached with the Control A, Alternate A1 (Alt A1) and Alternate A2 (Alt A) sequences described in Table 1. Note that sequences Alt A1 and Control A are not considered as within the scope of the present invention. Sufficient quantity of semibleached pulp was generated in order for the final stage charges to be determined and then to perform a large batch bleaching and PFI strength testing. If favorable results were obtained in Phase 1, then testing proceeded to Phase 2.

Phase 2 repeated Phase 1 for each type of pulp chosen. In addition to the comparison based on the short sequence Control A (Cntrl A), a case involving a long sequence Control B (Cntrl B) was also considered. The short sequence Case A (D Ep D) was used for $O_2$ delignified pulps and the long sequence Case B (D Ep D E D) was used for brownstock pulps. Adjustments to the conditions were made in order to provide a range of parameters. As the number of examples increased, a measurement such as viscosity was incorporated as an indicator of success if an adequate correlation was found between viscosity and strength. The Phase 2 data was used to include examples for a range of pulps and reaction conditions.

Laboratory Equipment

The first stage in each bleaching sequence was performed using a glass reactor designed specifically to simulate D100, DZ and ZD stages. The pulp equal to 50–90 gm oven dry was placed in the reactor and the required water was added to adjust for the desired consistency. Depending upon the requirement either chlorine dioxide or ozone was fed into the reactor to simulate bleaching. The reactor has a vertical shaft and blades at different locations of the shaft. Mixing inside the reactor was continuous. The pressure was less than one atmosphere gauge. Ozone gas was produced in a 7 g/hr ozone generator. The concentration of ozone produced and the quantity of ozone not consumed by the reaction are measured by iodometric titration. The injection time of the ozone stage is dependent on many factors such as concentration of ozone in oxygen, sample size, charge applied, and consistency. The retention time of the ozone treatment is actually the delivery or injection time needed to apply the required amount of ozone. Due to ozone kinetics, the rate of reaction is believed to be very fast. The range of temperature for the Z stage is 15–60° C. (higher temperature may decompose the O3 gas). Chlorine dioxide required for the study is injected through the side port to prevent any unreacted ozone venting out of the reactor.

Pulp Samples

Both hardwood (HW) and softwood (S) pulp types from various cooking processes were identified as worthy to be considered. They were—in order of priority:

SW Kraft—O2 Delignified (SKO)

SW Kraft Brownstock (SKB)

HW Kraft $O_2$ Delignified (HKO)

HW Kraft Brownstock (HKB)

THE SEQUENCES—Cases A and B, each with Control, Alternate 1 and Alternate 2 Sequences Two scenarios were considered for the entire testing, Case A and Case B, although Phase 1 only incorporated the short sequence Case A (Cntrl A, Alt A1 and Alt A2). Tables 1–2 describe the basic comparative sequences. The main difference between the Cntrl, Alt1 and Alt2 was the $ClO_2$:$O_3$ ratio in the first stage.

TABLE 1

Bleaching Sequence Comparison
Case A, The Three Stage Sequence, Example 1.

| Stage → | Stage 1 DO or (DZ) | Stage 2 Ep | Stage 3 D1 |
|---|---|---|---|
| Parameter↓ | — | — | — |
| Chemical Charges | Kappa Factor / Ozone (kg/ton) | $H_2O_2$ % / Caustic % | $C1O_2$ Levels (%) (required for target brightness, %) |
| Cntrl A | 0.27 / 0 | 0.2 / 0.4–1.8 | 0.5–1.5 (1.6) |
| Alt A1 | 0.27 / 6.0 | 0.02 / 0.4–1.8 | 0.5–1.2 (1.8) |
| Alt A2 | 0.14/ 6.0 | 0.2 / 0.4–1.8 | 0.5–1.5 (0.5) |
| Temperature (° C.) | 50 | 70 | 70 |
| Residence Time (min) | 40 + Z | 15 + 45 | 180 |
| Target Final pH | 2.5 | 11.0 | 3.5–4.0 |
| % Consistency | 2.5 | 10 | 10 |
| Final viscosity (mPa-s) | | | Cntrl A = 23.0<br>Alt 1 = 22.2<br>Alt 2 = 19.8 |
| Extraction Stage kappa number | | Cntrl A = 5.1<br>Alt 1 = 3.3<br>Alt 2 = 5.7 | |
| Final Brightness | Cntrl A = 38<br>Alt 1 = 43.6<br>Alt 2 = 38 | Cntrl A = 43.6<br>Alt 1 = 56.6<br>Alt 2 = 49.0 | 85 ISO |

Where (DZ) was employed, those stages and the corresponding control Do stages were performed at low consistency (2.5%). Data showed that for the first stage of bleaching, there was no difference in performance between 2.0, 2.5, and 3.5% consistencies.

The strength results are illustrated in FIGS. 1–4. Chemical pulps (kraft pulps) have strength potential for paper making but they are to be developed by means of a mechanical operation using refiners. Refining develops strength, improved sheet formation and surface properties. Because of the inherent heterogeneity of pulp, mean values, distribution curves, and extreme values are desired for a comprehensive characterization of fiber properties. There is a "qualitative inference of precision" of the test data given by the number of significant digits of the reported values, and "it is not customary to include sigma limits or confidence limits with most test values" for pulp and paper testing (see for example *Handbook for Pulp and Paper Technologists*, by G. Smook, p 310, published 1989 by TAPPI Press). In general, mechanical properties can be related to mean values; and comparison of tear-tensile relationships is best evaluated at freeness levels of 300 to 500 ml CSF. See for example *Pulp Bleaching: Principles and Practice*, by C. Dence and D. Reeve, pp 724–733, published 1996 by TAPPI Press.

TABLE 2

Bleaching Sequence Comparison
Case B, The Five Stage Sequence, Example 2.

| Stage → | Stage 1 D0 or (DZ) | Stage 2 Eop | Stage 3 D1 | Stage 4 E | Stage 5 D2 |
|---|---|---|---|---|---|
| Parameter ↓ | — | — | — | — | — |
| Chemical Charges | Kappa Factor/$O_3$% | $H_2O_2$%/ Caustic % | $ClO_2$(%) | Caustic % | $ClO_2$(%) |
| Cntrl B | 0.31/— | 0.2/ 0.4–1.8 | 0.5–1.2 (0.7) | 0.1–0.3 (0.2) | 0.2–0.5 (0.2) |
| Alt B1 | 0.31/0.6 | 0.2/ 0.4–1.8 | 0.2–0.8 (0.2) | 0.1–0.3 (0.2) | 0.1–0.3 (0.2) |
| Alt B2 | 0.16/0.6 | 0.2/ 0.4–1.8 | 0.5–1.2 (0.6) | 0.1–0.3 (0.2) | 0.2–0.5 (0.4) |
| Temperature (° C.) | 40 | 70 | 70 | 65 | 70 |
| Residence Time (min) | 40 + Z | 5 + 5 + 65 \| \| \| 45 + 25 + 0 | 180 | 60 | 180 |
| $O_2$ Pressure (psi) | — | | — | — | — |
| Target Final pH | 2.5 | 11.0 | 3.5–4.0 | 11.0 | 3.5–4.0 |
| % Consistency | 2.5 | 10 | 10 | 10 | 10 |
| Final viscosity (mPa-s) | — | — | — | — | Cntrl B = 27.6 Alt 1 = 21.8 Alt 2 = 20.0 |
| Extraction Stage kappa number | — | Cntrl B = 3.9 Alt 1 = 2.3 Alt 2 = 3.6 | — | — | — |
| Final Brightness | Cntrl B = 40.8 Alt 1 = 48.3 Alt 2 = 43 | Cntrl B = 58.9 Alt 1 = 68.2 Alt 2 = 62.5 | 85 ISO | — | 90 ISO |

Phase 1: The Core Example

The pulp chosen for this first trial was a softwood kraft oxygen delignified pulp with a starting kappa number of 22.2. It was bleached with the short sequence (Case A) to reach the target brightness of 85 ISO. The amount of pulp required for PFI strength testing was at least 1 50g POD for each sequence. To produce this amount of final bleached pulp, the bleaching was performed in several batches. The final D stage and the PFI strength testing was performed by Econotech Services. The inventors herein prepared 200 grams of each partial sequence to send to Econotech for final bleaching. Samples for Brightness, Kappa Number and Viscosity were collected and measured after each stage to document the findings.

Phase 2: More Examples

In this larger portion of the study, other types of pulp samples were bleached using either Case A or Case B. The brownstock pulps were bleached with the long sequence (designated Case B), and the $O_2$ pulps were bleached with the short sequence (designated Case A).

TABLE 3

Summary of the Example Pulps and Their Sequences

| Phase | Example 1 1 | Example 2* 2 | Example 3 2 | Example 4 2 |
|---|---|---|---|---|
| Fiber Type | softwood | softwood | hardwood | hardwood |
| Cooking Process Type | kraft | kraft | kraft | kraft |
| Brownstock or $O_2$- Delig. | $O_2$-delig. | Brownstock | $O_2$-delig. | brownstock |
| Starting Kappa | 22.2 | 23.3 | | |
| Short or Long Sequence | short | long | short | short |
| Sequences Cntrl | Case A DO Ep D1 | Case B DO Eop D1 E D2 | Case A DO Ep D1 | Case A DO Ep D1 |

TABLE 3-continued

Summary of the Example Pulps and Their Sequences

| Phase | Example 1 1 | Example 2* 2 | Example 3 2 | Example 4 2 |
|---|---|---|---|---|
| Alt 1 and 2 | (DZ) Ep D1 | (DZ) Eop D1 E D2 | (DZ) Ep D1 | (DZ) Ep D1 |
| CRC Code - New | 115-SKO1 | 115 SKB1 | 115 HKO1 | 115 HKB1 |
| CRC Code - Old | 103_01 | 100_02 | | 088_02 |

*Note that for Example 2, the brightness handsheets were prepared in accordance with the ISO standard mentioned above except: 1) Tap water was used instead of DI water, 2)No pH adjustment was performed, and 3)No EDTA was added.

To expedite this process, and help to validate the results, the pulp samples were bleached with the first and second stages by the inventors, and then the remaining stages were performed at Econotech Services where the PFI strength testing was performed. The PFI strength testing required at least 150 grams of fully bleached pulp from each sequence. In each example, there was a comparison of final strength between three bleaching sequences. To make this comparison, it was essential that the three samples had the same final brightness. In order to accomplish this, laboratory trials were performed prior to D1 to determine the proper $ClO_2$ charge in the D1 stage. The same determination was made for the D2 stage $ClO_2$ charge. A certain amount of excess pulp was needed for these experiments, and was provided by beginning with an adequate amount. In addition to this, consideration was taken for the amount of pulp that was removed along the way for brightness, kappa number and viscosity measurements. The limiting factor is the amount of pulp that can be processed at one time in the lab-scale low consistency reactor (i.e. 75 grams). Table 4 describes the expected amounts of pulp required for each step of the long sequence Case B in order to produce 150 grams of fully bleached pulp.

TABLE 4

| Stage → | Stage 1 DO or (DZ) | Stage 2 Ep | Stage 3 D1 | Stage 4 E | Stage 5 D2 |
|---|---|---|---|---|---|
| Grams of Pulp for:↓ | | | | | |
| Starting Batch POD Amt. × # of Batches = Total | 77 × 6 = = 450 | 70 × 6 = = 438 | 340 × 1 = 340 | 320 × 1 = 220 | 220 × 1 = 220 |
| or Hand-sheets(s) | (3 × 2) × 1 = 6 | (3 × 2) × 2 = 12 | 12 × 1 = 12 | 12 × 1 = 12 | 12 × 1 = 12 |
| for Viscosity | 5 × 1 = 5 | 5 × 1 = 5 | 5 × 1 = 5 | 5 × 1 = 5 | 5 × 1 = 5 |
| for Next Steo | 73 × 6 = 438 | 210 × 2 = 420 | 323 | 303 | 203 |
| Charge Scan for next stage | 20 × 3 = | — 60 | 20 × 3 = | — 60 | |
| Adjustment for losses | | 10 | 3 | 3 | 3 |
| Pulp available for next stage | | 340 | 320 | 220 | 200 |

This scenario required 6 batches of pulp for each of the three sequences when considering Case B in order to end with at least 150 grams of pulp. If any less batches were used, the final pulp mass would have been less than the minimum requirement for PFI strength testing. The Case A scenario only required 4 batches for each sequence.

Operating Conditions Coverage

The variations in reaction conditions were as follows:

Temperature in first stage 40°–75° C.

Residence Time in first stage 20–60 minutes

Consistency of first stage −2.0 to 12% Consistency

Increase Target Brightness to 89 ISO

Although the above examples and description are meant to be illustrative of the inventive adhesive and articles, they are not meant to unduly limit the scope of the following claims.

What is claimed is:

1. A method of bleaching a cellulose pulp using chlorine dioxide and ozone in one and the same single stage of a bleaching sequence having a plurality of stages, the method comprising a. first establishing strength characteristics for said pulp when bleached in a control bleaching sequence by bleaching the cellulose pulp using chlorine dioxide and no ozone to a target brightness, b. establishing a set of curves using chlorine dioxide and ozone at different ratios in a single stage to bleach the cellulose pulp to determine a ratio of chlorine dioxide to ozone in a range effective to achieve strength characteristics at least as great as the strength characteristics of the control bleaching sequence, with the bleaching sequence used to establish said set of curves being the same in all respect with the control bleaching sequence of step a, except in that the control bleaching sequence of step a does not employ ozone in the single stage, and c. controlling the ratio of chlorine dioxide to ozone in a single stage of a first bleaching sequence in the determined range of step b which is effective to achieve strength characteristics of a final paper elaborated from the first bleaching sequence at least as great as the strength characteristics of the control bleaching sequence, where essentially the same final brightness of pulp is elaborated from the first bleaching sequence as in the control bleaching sequence.

2. Method in accordance with claim 1 wherein the strength characteristics are selected from the group consisting of tensile index, tear index, burst index, and any combinations thereof.

3. Method in accordance with claim 1 wherein the first bleaching sequence has a ratio of D to Z ranging from about 0.5 to about 2.5.

4. Method in accordance with claim 1 wherein the pulp is selected from the group consisting of kraft, sulphite, oxygen delignified, chemical, mechanical, and chemical-mechanical pulps.

5. Method in accordance with claim 1 wherein the pulp has a consistency less than or equal to about 5 percent in the first stage of the first bleaching sequence.

6. A method of bleaching a cellulose pulp in a bleaching sequence $(D/Z)E_{op}D$ or $(Z/D)E_{op}D$ to produce a bleached pulp, the method comprising a. establishing a set of curves of properties defining the strength characteristics of a bleached pulp obtained by a control bleaching sequence $DE_{op}D$ where the cellulose pulp is bleached using chlorine dioxide and no ozone to a target brightness, b. establishing a set of curves using chlorine dioxide and ozone at different ratios in a single stage to bleach the cellulose pulp to determine a ratio of chlorine dioxide to ozone in a range effective to achieve strength characteristics at least as great as the strength characteristics of the control bleaching sequence, with the bleaching sequence used to establish said set of curves being the same in all respect with the control bleaching sequence of step a. except in that the control bleaching sequence of step a does not employ ozone in the single stage, and c. controlling the ratio of chlorine dioxide to ozone in a first bleaching stage (D/Z) or (Z/D) in the determined range of step b, which ratio is effective to produce a first set of curves of properties defining the strength characteristics of the bleached pulp to be substantially similar to or better than the set of curves of properties defining the strength characteristics of the bleached pulp obtained using the control bleaching sequence $DE_{op}D$, where the bleached pulp and the control bleach pulp have essentially the same brightness.

7. Method in accordance with claim 6 wherein the strength characteristics are selected from the group consisting of tensile index, tear index, burst index, and any combinations thereof.

8. Method in accordance with claim 6 wherein the first bleaching sequence has a ratio of D to Z ranging from about 0.5 to about 2.5.

9. Method in accordance with claim 6 wherein the pulp is selected from the group consisting of kraft, sulphite, oxygen delignified, chemical, mechanical, and chemical-mechanical pulps.

10. Method in accordance with claim 6 wherein the pulp has a consistency less than or equal to about 5 percent in the first stage of the first bleaching sequence.

11. A method of bleaching a cellulose pulp in a bleaching sequence (D/Z) $E_{op}DE_oD$ or (Z/D) $E_{op}DE_pD$ to produce a bleached pulp, the method comprising a. establishing a set of curves of properties defining strength characteristics of a bleached pulp prepared by a control bleaching sequence $DE_{op}DE_pD$ by bleaching cellulose pulp using chlorine dioxide and no ozone to a target brightness, b. establishing a set of curves using chlorine dioxide and ozone at different ratios in a single stage to bleach the cellulose pulp to determine a ratio of chlorine dioxide to ozone in a range effective to achieve strength characteristics at least as great as the strength characteristics of the control bleaching sequence, with the bleaching sequence used to establish said set of curves being the same in all respect with the control bleaching sequence of step a, except in that the control bleaching sequence of step a does not employ ozone in the single stage, and c. controlling the ratio of chlorine dioxide to ozone in a first bleaching stage (D/Z) or (Z/D) in the determined range of step b, which ratio is effective to produce a set of curves of properties defining the strength characteristics of the bleached pulp to be substantially similar to or better than the set of curves of properties defining the strength characteristics of the pulp bleached by the control bleaching sequence $DE_{op}DE_pD$, with the bleached pulp and the control bleached pulp having essentially the same brightness.

12. Method in accordance with claim 11 wherein the strength characteristics are selected from the group consisting of tensile index, tear index, burst index, and any combinations thereof.

13. Method in accordance with claim 11 wherein the first bleaching sequence has a ratio of D to Z ranging from about 0.5 to about 2.5.

14. Method in accordance with claim 11 wherein the pulp is selected from the group consisting of kraft, sulphite, oxygen delignified, chemical, mechanical, and chemical-mechanical pulps.

15. Method in accordance with claim 11 wherein the pulp has a consistency less than or equal to about 5 percent in the first stage of the first bleaching sequence.

16. A method of bleaching a cellulose pulp in a bleaching sequence $O(D/Z)E_{op}D$ or $O(Z/D)E_{op}D$ to produce a bleached pulp, the method comprising a. establishing a set of curves of properties defining strength characteristics of a bleached pulp prepared by a control bleaching sequence $ODE_{op}D$ by bleaching cellulose pulp using chlorine dioxide and no ozone to a target brightness, b. establishing a set of curves using chlorine dioxide and ozone at different ratios in a single stage to bleach the cellulose pulp to determine a ratio of chlorine dioxide to ozone in a range effective to achieve strength characteristics at least as great as the strength characteristics of the control bleaching sequence, with the bleaching sequence used to establish said set of curves being the same in all respect with the control bleaching sequence of step a, except in that the control bleaching sequence of step a does not employ ozone in the single stage, and c. controlling the ratio of chlorine dioxide to ozone in a first bleaching stage (D/Z) or (Z/D) in the determined range of step b, which ratio is effective to produce a set of curves of properties defining the strength characteristics of the bleached pulp to be substantially similar to or better than the set of curves of properties defining strength characteristics of the pulp bleached by the control bleaching sequence $DE_{op}DE_pD$, with the bleached pulp and the control bleached pulp having essentially the same brightness.

17. Method in accordance with claim 16 wherein the strength characteristics are selected from the group consisting of tensile index, tear index, burst index, and any combinations thereof.

18. Method in accordance with claim 16 wherein the first bleaching sequence has a ratio of D to Z ranging from about 0.5 to about 2.5.

19. Method in accordance with claim 16 wherein the pulp is selected from the group consisting of kraft, sulphite, oxygen delignified, chemical, mechanical, and chemical-mechanical pulps.

20. Method in accordance with claim 16 wherein the pulp has a consistency less than or equal to about 5 percent in the first stage of the first bleaching sequence.

21. A method of bleaching a cellulose pulp in a bleaching sequence $O(D/Z)E_oD$ or $O(Z/D)E_oD$ to produce a bleached pulp, the method comprising a. establishing a set of curves of properties defining strength characteristics of a bleached pulp prepared by a control bleaching sequence $ODE_oD$ by bleaching cellulose pulp using chlorine dioxide and no ozone to a target brightness, b. establishing a set of curves using chlorine dioxide and ozone at different ratios in a single stage to bleach the cellulose pulp to determine a ratio of chlorine dioxide to ozone in a range effective to achieve strength characteristics at least as great as the strength characteristics of the control bleaching sequence, with the bleaching sequence used to establish said set of curves being the same in all respect with the control bleaching sequence of step a, except in that the control bleaching sequence of step a does not employ ozone in the single stage, and c. controlling the ratio of chlorine dioxide to ozone in a first bleaching stage (D/Z) or (Z/D) in the determined range of step b, which ratio is effective to produce a set of curves of properties defining the strength characteristics of the bleached pulp to be substantially similar to or better than the set of curves of properties defining the strength characteristics of the pulp bleached by the control bleaching sequence $ODE_oD$, with the bleached pulp and the control bleached pulp having essentially the same brightness.

22. Method in accordance with claim 21 wherein the strength characteristics are selected from the group consisting of tensile index, tear index, burst index, and any combinations thereof.

23. Method in accordance with claim 21 wherein the first bleaching sequence has a ratio of D to Z ranging from about 1.5 to about 2.5.

24. Method in accordance with claim 21 wherein the pulp is selected from the group consisting of kraft, sulphite, oxygen delignified, chemical, mechanical, and chemical-mechanical pulps.

25. Method in accordance with claim 21 wherein the pulp has a consistency less than or equal to about 5 percent in the first stage of the first bleaching sequence.

* * * * *

UNITED STATES PATENT AND TRADEMARK OFFICE

CERTIFICATE OF CORRECTION

PATENT NO. : 6,174,409 B1 
DATED : January 16, 2001
INVENTOR(S) : V.S. Meenakshi Sundaram, Steven A. Fisher and Sebastien Corbeil It is certified that error appears in the above-identified patent and that said Letters Patent is hereby corrected as shown below:

Title Page,
In the title, change "Ration" to --Ratio--.

Column 1,
In the title, change "Ration" to --Ratio--.

Column 12,
Line 34, change "a. except" to --a, except--.
Line 61, change "sequence (D/Z) $E_{op}DE_oD$" to --sequence (D/Z) $E_{op}DE_pD$--.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*